United States Patent [19]

Earl

[11] Patent Number: 4,828,487

[45] Date of Patent: May 9, 1989

[54] SWIRL GENERATOR

[76] Inventor: Arnold M. Earl, 1325 Applewood Road, Mississauga, Ontario, Canada, L5F 2L9

[21] Appl. No.: 173,557

[22] Filed: Mar. 21, 1988

[51] Int. Cl.[4] ..... F23C 7/00; F23Q 9/00

[52] U.S. Cl. ..... 431/187; 431/284; 431/285

[58] Field of Search ..... 431/173, 177, 182, 187, 431/284, 285; 126/116 R

[56] References Cited

U.S. PATENT DOCUMENTS

| | | | |
|---|---|---|---|
| 1,910,735 | 5/1933 | Zikesch | 431/285 X |
| 1,951,379 | 3/1934 | Voorheis | 431/284 X |
| 1,986,796 | 1/1935 | Florex . | |
| 2,647,568 | 8/1953 | Sloan | 431/284 X |
| 2,821,246 | 1/1958 | Ide et al. | 431/284 X |
| 2,851,093 | 9/1958 | Zink, Jr. et al. | 431/174 |
| 2,941,585 | 6/1960 | Loebel et al. | 431/285 X |
| 2,982,347 | 5/1961 | Kidwell et al. | 431/285 X |
| 3,033,273 | 5/1962 | Zink Jr. et al. | 431/285 X |
| 3,111,979 | 11/1963 | Peoples | 431/285 X |
| 3,174,527 | 3/1965 | Reed et al. | 110/260 X |
| 3,217,779 | 11/1965 | Reed et al. | 431/285 |
| 3,748,087 | 7/1973 | Shular | 431/182 |
| 3,857,672 | 12/1974 | Reed et al. | 431/173 X |
| 4,375,954 | 3/1983 | Trudel | 431/285 X |
| 4,475,885 | 10/1984 | Finke | 431/182 |
| 4,610,625 | 9/1986 | Bunn | 431/285 X |

*Primary Examiner*—Randall L. Green

*Attorney, Agent, or Firm*—Fetherstonhaugh & Co.

[57] ABSTRACT

A swirl generator is provided in a combustion chamber of a furnace or the like which serves to discharge a stream of secondary combustion medium into the combustion chamber along a path which extends circumferentially of the flame of the primary combustion burner so as to induce a rotary mixing action in the primary combustion chamber which will serve to contain the primary combustion flame in the combustion chamber.

1 Claim, 4 Drawing Sheets

SWIRL GENERATOR

This invention relates to combustion chambers. In particular, this invention relates to improvements in combustion chamber of a furnace or the like which serve to increase combustion efficiency.

PRIOR ART

In furnaces in which the primary combustion fuel is a heavy fuel such as a heavy fuel oil, it is customary to propel the fuel oil into the furnace at a substantial velocity in order to reduce the particle size of the heavy fuel oil to a sufficient extent to maximize the combustion efficiency. As a result, the flame which is generated tends to be an elongated flame which is centered in the combustion chamber and is spaced a substantial distance from the walls of the combustion chamber. In many furnaces where the flue gases are discharged from the combustion chamber into a heat exchanger, difficulty is experienced in attempting to ensure that the length of the flame which is generated in the combustion chamber is not so great that it will extend into the heat exchanger chamber. If the flame extends into the heat exchanger chamber, it may be cooled before the combustion is complete and this can result in soot deposits in the heat exchanger which will damage the efficiency of operation of the heat exchanger.

I have found that it is possible to increase the efficiency of combustion of the primary flame of a combustion chamber by providing a swirl generator which introduces a secondary combustion medium into the combustion chamber to generate an annular ring of said second combustion medium which swirls around the primary flame in close proximity to the input end of the primary flame. The centrifugal forces generated by the swirling annular ring of the secondary combustion medium will serve to induce rotational mixing in the primary combustion flame which will slow the rate of propagation of the flame toward the discharge end of the combustion chamber to thereby increase the combustion efficiency of the flame.

Preferably the secondary combustion medium which is introduced by the swirl generator is a volatile combustable gas such as natural gas, propane or a light fuel oil.

According to one aspect of the present invention there is provided in a combustion chamber of a furnace or the like, a primary passage opening into the combustion chamber through a first wall thereof, a burner arranged to direct a primary flame through the primary passage into the combustion chamber along a first axis which extends inwardly of the combustion chamber from the first wall, the improvement of swirl generator means in the combustion chamber for inducing rotational motion in the primary flame in close proximity to said wall. The swirl generator comprises a plurality of secondary passages opening into the combustion chamber in close proximity to the first wall. The secondary passages are circumferentially spaced about the first axis. Each secondary passage has an outlet which is arranged to discharge a stream of a secondary combustion medium into the combustion chamber along a path which is substantially tangential to the first axis and extends in a plane which is substantially normal to the first axis so as to generate an annular ring of second combustion medium which swirls around the primary flame in close proximity to said first wall to induce a rotary mixing action in the primary flame and thereby enhance the combustion efficiency of the main flame.

The invention will be more clearly understood after reference to the following detailed specification read in conjunction with the drawings wherein.

Figure 1:
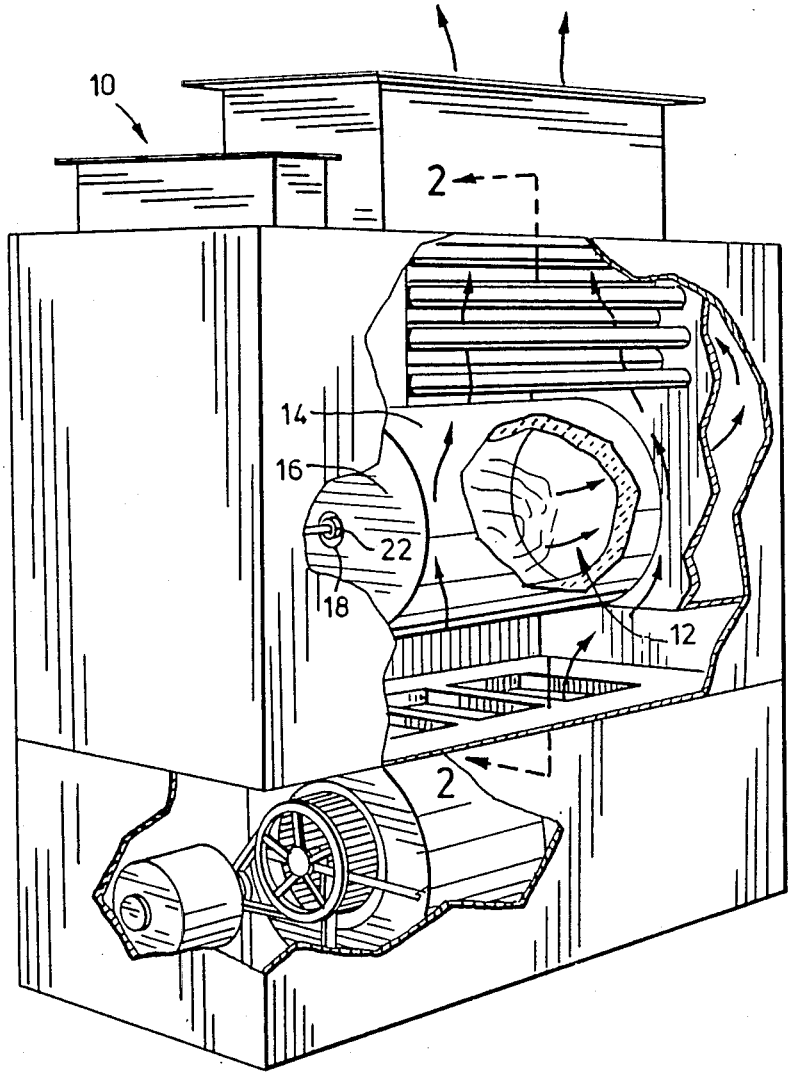
FIG. 1 is a partially sectioned pictorial view of a boiler incorporating a burner assembly which has a combustion chamber constructed in accordance with an embodiment of the present invention.
Figure 2:
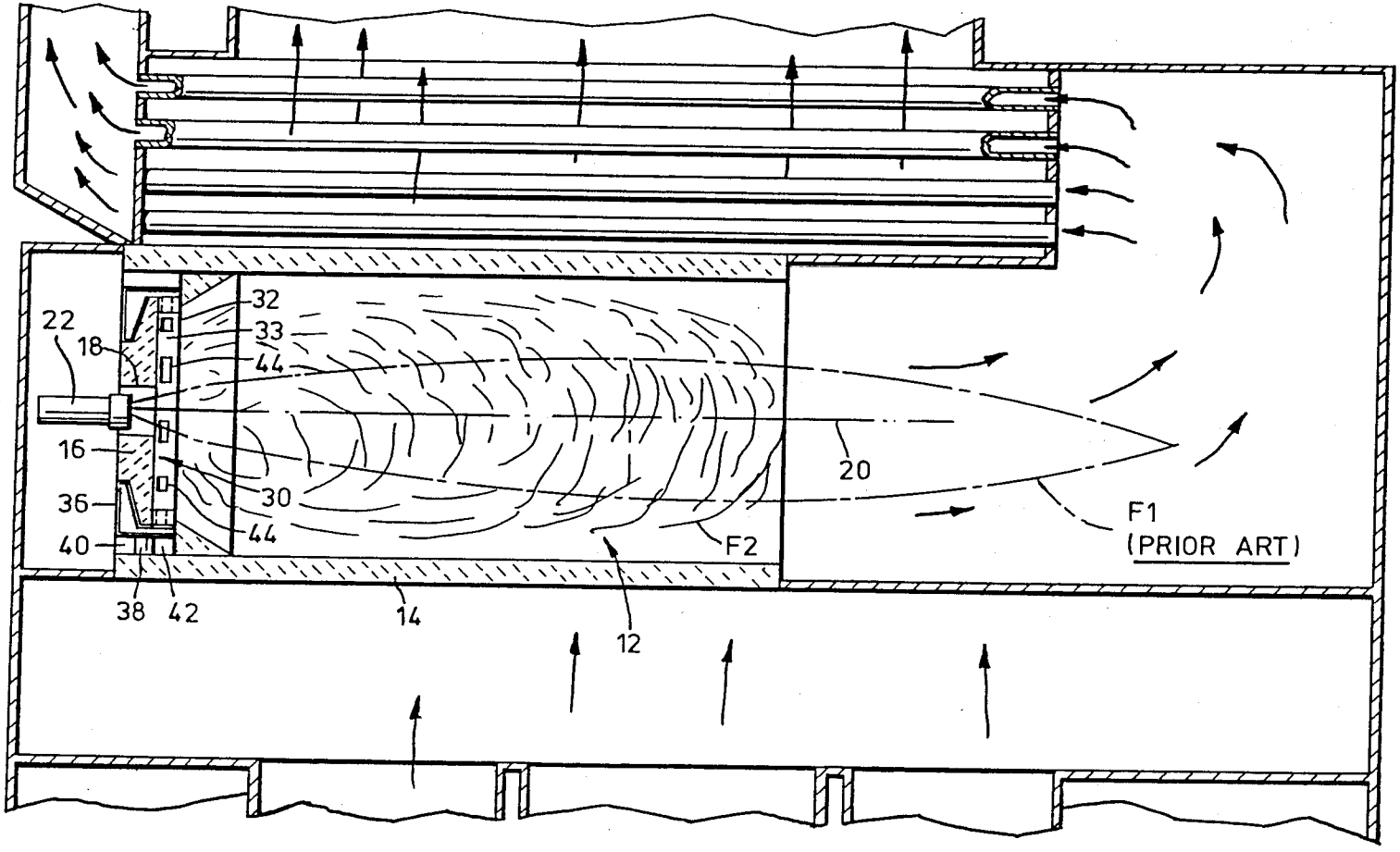
FIG. 2 is a sectional side view taken along the line 2—2 of FIG. 1.
Figure 3:
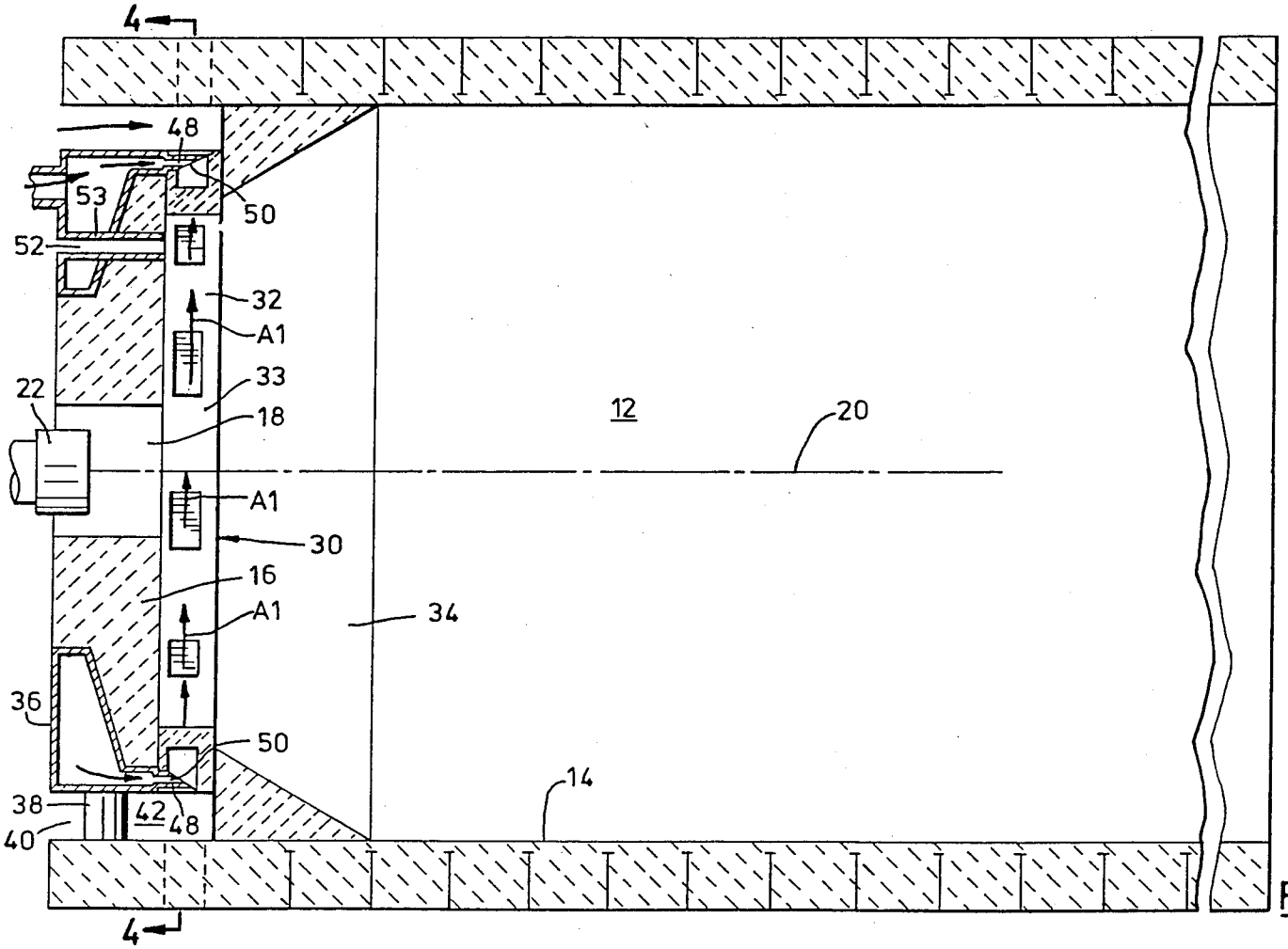
FIG. 3 is an enlarged sectional side view of the combustion chamber of FIG. 2.
Figure 4:
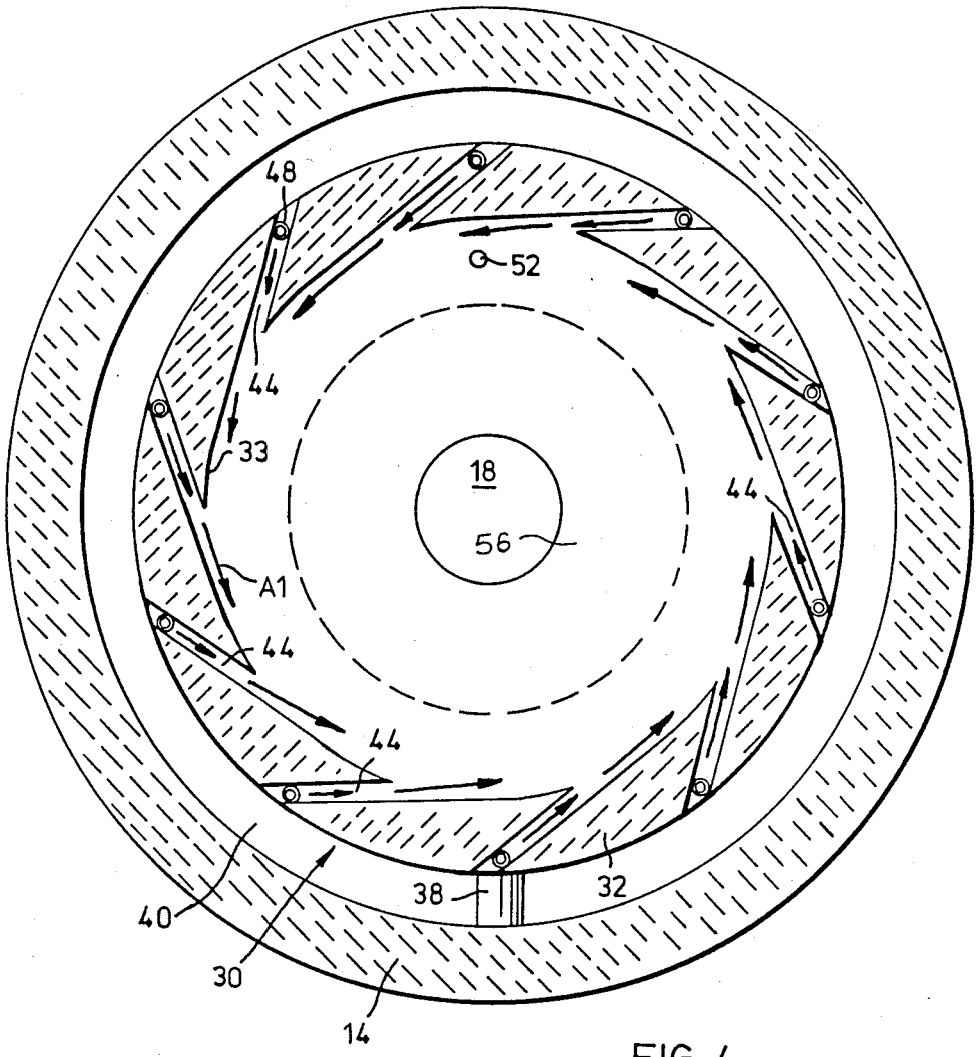
FIG. 4 is a sectional end view taken along the line 4-4 of FIG. 3.

With reference to FIG. 1 of the drawings, the reference numeral 10 refers generally to a boiler which incorporates a combustion chamber 12 which is constructed in accordance with an embodiment of the present invention. The combustion chamber 12 is formed with a circumferentially extending side wall 14 and an end wall 16, both of which are lined with a refractory material. The end wall 16 is formed with a central opening 18 which functions as an input passage for the burner 22. As shown in FIG. 2 of the drawings, the burner 22 is arranged to discharge fuel directly into the combustion chamber 12 along the first axis 20 which is centrally located with respect to the combustion chamber 12.

Combustion chambers of the type described above are well known and consequently, a detailed description of the structure of the combustion chamber is not deemed to be necessary.

In a combustion chamber of the type described above, when the burner is in use, the flame which is generated will generally assume the longitudinally elongated configuration shown in broken lines in FIG. 2 and identified as $F_1$ (prior art).

With the improvement of the present invention, the flame is modified to assume the shorter configuration which is outlined and identified as $F_2$ in FIG. 2.

This modification of the configuration of the flame is achieved by means of a swirl generator which is generally identified by the reference numeral 30. The swirl generator comprises an annular ring or collar 32. The inner face 33 of the collar 32 serves to form the throat of the secondary combustion burner of the swirl generator. A tapered throat ring 34 extends from the collar 32 to the side wall 14. An annular manifold 36 is mounted in and extends circumferentially of the outer perimeter of the end wall 16. A spacer rod 38 serve to support the end wall 16 and manifold 36 in a spaced relationship with respect to the side wall 14 to form an air passage 40 which communicate with a wind box which is mounted on the end of the combustion enclosure in a conventional manner. An annular air manifold 42 is provided radially outwardly from the collar 32. Swirl generating passages 44 open through the collar 32 from the air manifold 42 into the combustion chamber 12. The swirl generating passages 44 are angularly inclined so as to discharge a stream of secondary combustion medium such as natural gas, propane, vapourized light fuel oil or the like into the combustion chamber along a path which extends substantially circumferentially of the inner face 33 of the collar 32 in the direction of the Arrow $A_1$.

The manifold 36 is formed with a plurality of discharge tubes 48. One of the discharge tube 48 is located in each swirl generating passage 44. The tubes 48 have an angularly inclined end face 50 through which the discharge passage of the tube extends. In use, the air which is driven through the swirl generating passage 44 will induce gaseous fuel to flow from the manifold 36 through the tubes 48 and discharge passage 50 and through the swirl generating passages in the direction of the Arrow A1. This mixture of air and gaseous fuel is ignited to form a flame which swirls in close proximities to the end face 56 of the end wall 16 and the ring 32.

An ignition access passage 52 extends through a tube 53 to provide access to the secondary combustion medium which is discharged through the passages 44 for use in igniting the medium. This in turn, serves to ignite the primary flame.

In use, a swirl generator is activated and ignited to generate a swirling flame which extend along a generally annular path in close proximity to the swirl generator which will diverge as it travels longitudinally of the combustion chamber. The centrifugal effect of the swirling flame will tend to draw the gaseous medium away from the longitudinal axis 20. When the burner 22 is activated, its fuel is ignited by the flame of the secondary fuel. The primary flame which is normally discharged axially along the axis 20 in the configuration F1 is also drawn radially outwardly by the centrifugal effect of the swirling flame to combine with the swirling flame to provide a flame having the general configuration of the flame F2. I have found that in this manner, it is possible to provide for the more complete combustion of the primary fuel which is discharged from the burner. With the aid of the swirl generator, I am able to increase the temperature to which the end wall 16 and throat ring 34 are heated and this contributes to the ability to provide for complete combustion and it serves to reduce the likelihood of a "flame-out" of the primary fuel.

I claim:

1. In a combustion chamber of a furnace or the like, a primary passage opening into the combustion chamber through a first end wall which extends radially from said primary passage, a burner arranged to direct a primary flame through the primary passage and into the combustion chamber along a first axis which extends inwardly of the combustion chamber from said first end wall, the improvement of;

swirl generating means in said combustion chamber for inducing rotational motion in the primary flame in close proximity to said first end wall comprising;

an annular collar extending from said first end wall into said combustion chamber, said annular collar being arranged concentrically with respect to said first axis and having an inner face which is spaced radially outwardly from said first axis, a plurality of secondary passages opening through said annular collar into said combustion chamber in close proximity to said first end wall, said secondary passages being circumferentially spaced about said first axis, each secondary passage having an outlet which opens through the inner face of said annular collar and is arranged to discharge into the combustion chamber along a path which is substantially tangential to said first axis and extends in a plane which is substantially normal to the first axis so as to generate an annular ring of secondary combustion medium which swirls around the primary flame in close proximity to said first end wall to induce a rotary mixing action in the primary flame which will rapidly heat said first end wall and thereby prevent carbon build-up within the collar and enhance the combustion efficiency and retention of the primary flame.

* * * * *